US010399119B2

(12) United States Patent
Eason et al.

(10) Patent No.: US 10,399,119 B2
(45) Date of Patent: Sep. 3, 2019

(54) FILMS, INTERMEDIATE STRUCTURES, AND METHODS FOR FORMING HARDFACING

(71) Applicant: Baker Hughes Incorporated, Houston, TX (US)

(72) Inventors: Jimmy W. Eason, The Woodlands, TX (US); Travis E. Puzz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 586 days.

(21) Appl. No.: 14/949,403

(22) Filed: Nov. 23, 2015

(65) Prior Publication Data

US 2016/0074905 A1 Mar. 17, 2016

Related U.S. Application Data

(62) Division of application No. 13/567,222, filed on Aug. 6, 2012, now Pat. No. 9,199,273, which is a division (Continued)

(51) Int. Cl.
*B22F 7/06* (2006.01)
*B05D 7/00* (2006.01)

(Continued)

(52) U.S. Cl.
CPC ..... *B05D 7/5483* (2013.01); *B05D 3/007* (2013.01); *B05D 5/02* (2013.01); *B22F 7/06* (2013.01);

(Continued)

(58) Field of Classification Search
None
See application file for complete search history.

(56) References Cited

U.S. PATENT DOCUMENTS 3,012,881 A 12/1961 Cape
3,743,556 A 7/1973 Bailey et al.

(Continued)

FOREIGN PATENT DOCUMENTS

CN 200720037743 5/2008
EP 265839 A2 5/1988

(Continued)

OTHER PUBLICATIONS

Ceramer, Innovative High Performance Polymers and Additives, www.ceranner.com/the_material/20_material.php, visited Jul. 21, 2011, 1 page.

(Continued)

*Primary Examiner* — Jessee R Roe
*Assistant Examiner* — Ngoclan T Mai
(74) *Attorney, Agent, or Firm* — TraskBritt

(57) ABSTRACT

A multi-layer film for use in forming a layer of hardfacing on a surface of a tool includes a first layer and a second layer covering at least a portion of a surface of the first layer. The layers each include a polymer material and a plurality of particles dispersed throughout the polymer material. An intermediate structure includes a body of an earth-boring tool, a first material layer disposed over a surface of the body, and a second material layer disposed over the first material layer. A method of applying hardfacing includes providing a first material layer on a surface of a body of an earth-boring tool, providing a second material layer adjacent the first material layer, heating the body and removing the polymer material from the body of the earth-boring tool, and heating the body of the earth-boring tool to a higher temperature to form a layer of hardfacing material.

15 Claims, 8 Drawing Sheets

Related U.S. Application Data of application No. 12/398,066, filed on Mar. 4, 2009, now Pat. No. 8,252,225.

(51) Int. Cl.

| | |
|---|---|
| ***B05D 5/02*** | (2006.01) |
| ***C22C 29/00*** | (2006.01) |
| ***B05D 3/00*** | (2006.01) |
| ***E21B 10/46*** | (2006.01) |

(52) U.S. Cl.

CPC ..... *C22C 29/00* (2013.01); *E21B 10/46* (2013.01); *B05D 2507/00* (2013.01); *B05D 2601/26* (2013.01); *B05D 2601/28* (2013.01); *B22F 2998/10* (2013.01); *B22F 2999/00* (2013.01); *C22C 2204/00* (2013.01); *Y10T 428/31678* (2015.04); *Y10T 428/31692* (2015.04); *Y10T 428/31696* (2015.04)

(56) References Cited

U.S. PATENT DOCUMENTS

| | | | | |
|---|---|---|---|---|
| 3,800,891 | A | 4/1974 | White | |
| 3,916,506 | A | 11/1975 | Wolf | |
| 3,989,554 | A | 11/1976 | Wisler | |
| 4,073,951 | A | 2/1978 | Sargeant | |
| 4,228,214 | A | 10/1980 | Steigelman et al. | |
| 4,228,339 | A | 10/1980 | Scales et al. | |
| 4,243,727 | A | 1/1981 | Wisler et al. | |
| 4,420,459 | A | 12/1983 | Mizuhara | |
| 4,431,465 | A | 2/1984 | Mizuhara et al. | |
| 4,448,270 | A | 5/1984 | Buske | |
| 4,516,642 | A | 5/1985 | Childers et al. | |
| 4,546,837 | A | 10/1985 | Childers et al. | |
| 4,558,754 | A | 12/1985 | Childers | |
| 4,582,149 | A | 4/1986 | Slaughter | |
| 4,685,359 | A | 8/1987 | Worthen et al. | |
| 4,724,911 | A | 2/1988 | Buske et al. | |
| 4,726,432 | A | 2/1988 | Scott et al. | |
| 4,741,406 | A | 5/1988 | Deane et al. | |
| 4,759,415 | A | 7/1988 | Pessier | |
| 4,772,322 | A | 9/1988 | Bellis et al. | |
| 4,776,412 | A | 10/1988 | Thompson | |
| 4,794,995 | A | 1/1989 | Matson et al. | |
| 4,797,251 | A | 1/1989 | Sakuramoto et al. | |
| 4,848,476 | A | 7/1989 | Deane et al. | |
| 4,849,163 | A | 7/1989 | Bellis et al. | |
| 4,884,477 | A | 12/1989 | Smith et al. | |
| 4,919,013 | A | 4/1990 | Smith et al. | |
| 4,989,680 | A | 2/1991 | Deane et al. | |
| 5,029,656 | A | 7/1991 | Ivie et al. | |
| 5,038,640 | A | 8/1991 | Sullivan et al. | |
| 5,072,796 | A | 12/1991 | Shen et al. | |
| 5,096,005 | A | 3/1992 | Ivie et al. | |
| 5,164,247 | A | 11/1992 | Solanki et al. | |
| 5,267,600 | A | 12/1993 | Revankar et al. | |
| 5,290,842 | A * | 3/1994 | Sasaki | C09J 121/00 524/271 |
| 5,335,738 | A | 8/1994 | Waldenstrom et al. | |
| 5,352,526 | A | 10/1994 | Solanki et al. | |
| 5,403,544 | A | 4/1995 | Adrian et al. | |
| 5,492,186 | A | 2/1996 | Overstreet et al. | |
| 5,508,334 | A | 4/1996 | Chen | |
| 5,574,957 | A | 11/1996 | Barnard et al. | |
| 5,607,024 | A * | 3/1997 | Keith | E21B 10/43 175/431 |
| 5,663,512 | A | 9/1997 | Schader et al. | |
| 5,669,459 | A | 9/1997 | Larsen et al. | |
| 5,676,214 | A | 10/1997 | Pearce et al. | |
| 5,829,539 | A | 11/1998 | Newton et al. | |
| 5,853,055 | A | 12/1998 | Siracki et al. | |
| 5,879,743 | A | 3/1999 | Revankar | |
| 5,944,128 | A | 8/1999 | Truax et al. | |
| 5,952,042 | A | 9/1999 | Rafferty et al. | |
| 6,029,759 | A | 2/2000 | Sue et al. | |
| 6,098,728 | A | 8/2000 | Wells et al. | |
| 6,098,730 | A | 8/2000 | Scott et al. | |
| 6,206,115 | B1 | 3/2001 | Overstreet et al. | |
| RE37,127 | E | 4/2001 | Schader et al. | |
| 6,248,149 | B1 | 6/2001 | Massey et al. | |
| 6,253,862 | B1 | 7/2001 | Overstreet et al. | |
| 6,354,387 | B1 | 3/2002 | Harris et al. | |
| 6,360,832 | B1 | 3/2002 | Overstreet et al. | |
| 6,436,470 | B1 | 8/2002 | Iacocca et al. | |
| 6,571,887 | B1 | 6/2003 | Nguyen et al. | |
| 6,649,682 | B1 | 11/2003 | Breton et al. | |
| 6,651,756 | B1 | 11/2003 | Costo, Jr. et al. | |
| 6,763,902 | B2 | 7/2004 | Larsen et al. | |
| 6,766,870 | B2 | 7/2004 | Overstreet | |
| 6,772,849 | B2 | 8/2004 | Oldham et al. | |
| 6,849,338 | B2 | 2/2005 | Clemens | |
| 6,974,606 | B2 | 12/2005 | DiMarzio et al. | |
| 7,213,661 | B2 | 5/2007 | Larsen et al. | |
| 7,237,628 | B2 | 7/2007 | Desai et al. | |
| 7,240,746 | B2 | 7/2007 | Overstreet et al. | |
| 7,252,164 | B2 | 8/2007 | Hossain et al. | |
| 7,255,328 | B2 | 8/2007 | Hunter | |
| 7,303,030 | B2 | 12/2007 | Lockwood et al. | |
| 7,337,941 | B2 | 3/2008 | Scott et al. | |
| 7,343,990 | B2 | 3/2008 | Pessier et al. | |
| 7,361,411 | B2 | 4/2008 | Daemen et al. | |
| 7,487,840 | B2 | 2/2009 | Gammage et al. | |
| 7,828,089 | B2 | 11/2010 | Buske et al. | |
| 8,252,225 | B2 | 8/2012 | Eason et al. | |
| 2005/0146086 | A1 | 7/2005 | Pope et al. | |
| 2006/0090937 | A1 * | 5/2006 | McDonough | B22F 7/08 175/374 |
| 2006/0183841 | A1 | 8/2006 | Aneja et al. | |
| 2007/0000698 | A1 | 1/2007 | Viswanadham | |
| 2007/0017160 | A1 * | 1/2007 | Caldwell | B24D 3/00 51/298 |
| 2007/0079992 | A1 | 4/2007 | Curry et al. | |
| 2007/0102199 | A1 | 5/2007 | Smith et al. | |
| 2007/0107908 | A1 | 5/2007 | Vaidya et al. | |
| 2007/0163812 | A1 | 7/2007 | Overstreet et al. | |
| 2007/0173590 | A1 | 7/2007 | Longo et al. | |
| 2007/0227781 | A1 | 10/2007 | Cepeda et al. | |
| 2008/0000689 | A1 | 1/2008 | Peter | |
| 2008/0026226 | A1 * | 1/2008 | Abe | G01N 33/525 428/411.1 |
| 2008/0105438 | A1 | 5/2008 | Jordan et al. | |
| 2009/0114807 | A1 | 5/2009 | Kirkwood et al. | |
| 2009/0272731 | A1 | 11/2009 | Olding et al. | |
| 2009/0276158 | A1 | 11/2009 | Kirkwood et al. | |
| 2010/0188080 | A1 | 7/2010 | Kruspe et al. | |
| 2010/0201359 | A1 | 8/2010 | Rottengatter | |
| 2012/0298426 | A1 | 11/2012 | Eason et al. | |
| 2013/0025941 | A1 | 1/2013 | Kumar et al. | |

FOREIGN PATENT DOCUMENTS

| | | | |
|---|---|---|---|
| EP | 761786 | A2 | 7/2002 |
| EP | 1621272 | A2 | 2/2006 |
| GB | 708352 | A | 5/1954 |
| GB | 804179 | A | 11/1958 |
| JP | 09071735 | A | 3/1997 |
| KR | 19910008563 | B1 | 10/1991 |
| WO | 2005052210 | A1 | 6/2005 |
| WO | 2006076341 | A2 | 7/2006 |
| WO | 2007059267 | A1 | 5/2007 |
| WO | 2008042330 | A1 | 4/2008 |
| WO | 2008060405 | A2 | 5/2008 |
| WO | 2008079285 | A1 | 7/2008 |
| WO | 2009018427 | A1 | 2/2009 |

OTHER PUBLICATIONS

European Search Report and Opinion for European Application No. 10155241.2-1215 dated Jul. 5, 2010, 9 pages.

Juliot, Chad et al., "Erosion Resistance of Infiltration Brazed Tungsten Carbide Cladding," 2005 Engineering, Pulp 2005 Engi-

(56) References Cited

OTHER PUBLICATIONS neering, Pulping & Environmental Conference (2005) 9 pages. &
Environmental Conference (2005) 9 pages.

* cited by examiner

FILMS, INTERMEDIATE STRUCTURES, AND METHODS FOR FORMING HARDFACING

CROSS-REFERENCE TO RELATED APPLICATIONS

This application is a divisional of U.S. patent application Ser. No. 13/567,222, filed Aug. 6, 2012, now U.S. Pat. No. 9,199,273, issued Dec. 1, 2015, which is a divisional of U.S. patent application Ser. No. 12/398,066, filed Mar. 4, 2009, in the name of Eason et al., now U.S. Pat. No. 8,252,225, issued Aug. 28, 2012, the disclosures of which are hereby incorporated herein by this reference in their entirety.

The present application is related to U.S. patent application Ser. No. 11/957,207, filed Dec. 14, 2007, now U.S. Pat. No. 7,828,089, issued Nov. 9, 2010, which is assigned to the Assignee of the present application.

TECHNICAL FIELD

The present invention relates generally to methods of forming wear-resistant materials, methods of using wear-resistant materials to form earth-boring tools having increased wear-resistance and earth-boring tools including wear-resistant material. More particularly, the present invention relates to earth-boring tools and components thereof that are relatively resistant to erosion caused by the flow of fluid through fluid passageways extending therethrough, to methods of forming such earth-boring tools, and methods of forming erosion-resistant materials for use in such tools.

BACKGROUND

Earth-boring tools are commonly used for forming (e.g., drilling and reaming) wellbore holes (hereinafter "wellbores") in earth formations. Earth-boring tools include, for example, rotary drill bits, core bits, eccentric bits, bicenter bits, reamers, underreamers, and mills.

Earth-boring rotary drill bits have several configurations. One configuration is the fixed-cutter drill bit, which typically includes a plurality of wings or blades each having multiple cutting elements fixed thereon. Another configuration is the roller cone bit, which typically includes three cones mounted on supporting bit legs that extend from a bit body, which may be formed from, for example, three bit head sections that are welded together to form the bit body. Each bit leg may depend from one bit head section. Each roller cone is configured to rotate on a bearing shaft that extends from a bit leg in a radially inward and downward direction from the bit leg. The cones are typically formed from steel, but they also may be formed from a particle-matrix composite material (e.g., a cermet composite such as cemented tungsten carbide). Cutting teeth for cutting rock and other earth formations may be machined or otherwise formed in or on the outer surfaces of each cone. Alternatively, receptacles are formed in outer surfaces of each cone, and inserts formed of hard, wear-resistant material, in some instances coated with a superabrasive material such as polycrystalline diamond, are secured within the receptacles to form the cutting elements of the cones.

A rotary drill bit may be placed in a bore hole such that the cutting structures thereof are adjacent and in contact with the earth formation to be drilled. As the drill bit is rotated under longitudinal force applied to a drill string to which the rotary drill bit is secured, the cutting structures remove the adjacent formation material.

It is known in the art to apply wear-resistant materials, such as so-called "hardfacing" materials, to the formation-engaging surfaces of rotary drill bits to minimize wear of those surfaces of the drill bits caused by abrasion. For example, abrasion occurs at the formation-engaging surfaces of an earth-boring tool when those surfaces are engaged with and sliding relative to the surfaces of a subterranean formation in the presence of the solid particulate material (e.g., formation cuttings and detritus) carried by conventional drilling fluid. For example, hardfacing may be applied to cutting teeth on the cones of roller cone bits, as well as to the gage surfaces of the cones. Hardfacing also may be applied to the exterior surfaces of the curved lower end or "shirttail" of each bit leg, and other exterior surfaces of the drill bit that are likely to engage a formation surface during drilling. Hardfacing also may be applied to formation-engaging surfaces of fixed-cutter drill bits.

During drilling, drilling fluid is pumped down the wellbore through the drill string to the drill bit. The drilling fluid passes through an internal longitudinal bore within the drill bit and through other fluid conduits or passageways within the drill bit to nozzles that direct the drilling fluid out from the drill bit at relatively high velocity. The nozzles may be directed toward the cutting structures to clean debris and detritus from the cutting structures and prevent "balling" of the drill bit. The nozzles also may be directed past the cutting structures and toward the bottom of the wellbore to flush debris and detritus off from the bottom of the wellbore and up the annulus between the drill string and the casing (or exposed surfaces of the formation) within the wellbore, which may improve the mechanical efficiency of the drill bit and the rate of penetration (ROP) of the drill bit into the formation.

It is known in the art to use flow tubes to direct drilling fluid to a nozzle and out from the interior of a drill bit, particularly when it is desired to direct drilling fluid past the cones of a roller cone drill bit and toward the bottom of the wellbore. Such flow tubes may be separately formed from the bit body, and may be attached to the bit body (e.g., bit head section or bit leg) by, for example, welding the flow tubes to the bit body. A fluid course or passageway is formed through the bit body to provide fluid communication between the interior longitudinal bore of the drill bit and the fluid passageway within the flow tube.

As drilling fluid is caused to flow through the flow tubes and/or fluid passageways within a drill bit, the drilling fluid erodes away the interior surfaces of the flow tube and bit body. Such erosion may be relatively more severe at locations at which the direction of fluid flow changes, since the drilling fluid impinges on the interior surfaces of the flow tube or bit body at relatively higher angles at such locations. This erosion can eventually result in the formation of holes that extend completely through the walls of the flow tube or bit body, thereby allowing drilling fluid to exit the flow tube or bit body before passing through the nozzle, which eventually leads to failure of the designed hydraulic system of the drill bit. When the hydraulic system of the drill bit fails, the rate of penetration decreases and the drill bit becomes more susceptible to "balling." Ultimately, the drill bit may fail and need to be replaced.

BRIEF SUMMARY

Embodiments of the present invention include multi-layer films for use in forming a layer of hardfacing on a surface of a tool. The films include a first layer that includes a first polymer material and a first plurality of particles dispersed throughout the first polymer material. A second layer covers at least a portion of a surface of the first layer and includes a second polymer material and a second plurality of particles dispersed throughout the second polymer material.

Additional embodiments of the present invention include intermediate structures formed during fabrication of an earth-boring tool that include a body of an earth-boring tool, a first material layer disposed over at least a portion of the surface of the body, and a second material layer disposed over at least a portion of the first material layer on a side thereof opposite the body. The first material layer includes a plurality of hard particles dispersed throughout a first polymer material, and the second material layer includes a plurality of metallic matrix particles dispersed throughout a second polymer material.

In additional embodiments, the present invention includes methods of applying hardfacing to a surface of an earth-boring tool. A plurality of hard particles, a plurality of metal matrix particles, a polymer material, and a liquid solvent may be mixed together to form a paste, which may be spread over a surface of a substrate to form a layer of the paste. The liquid solvent may be removed from the layer of the paste to form an at least substantially solid film that includes the plurality of hard particles, the plurality of metal matrix particles, and the polymer material. The film may be removed from the surface of the substrate and applied to a surface of a body of an earth-boring tool. The body of the tool may be heated to a first temperature while the film is on the body of the tool to remove the polymer material from the body of the earth-boring tool. The body of the earth-boring tool may then be heated to a second temperature higher than the first temperature to sinter at least the plurality of metal matrix particles to form a layer of hardfacing material on the surface of the body of the earth-boring tool that includes the plurality of hard particles dispersed throughout a metal matrix phase formed from the plurality of metal matrix particles.

Additional embodiments of the present invention include methods of applying hardfacing to a surface of an earth-boring tool. A first material that includes a plurality of hard particles and a first polymer material may be provided on a surface of a body of an earth-boring tool. A second material layer that includes a plurality of metal matrix particles and a second polymer material may be provided adjacent the first material layer on a side thereof opposite the body of the earth-boring tool. The body of the tool is heated to a first temperature while the first material layer and the second material layer are on the body of the earth-boring tool to remove the first polymer material and the second polymer material from the body of the earth-boring tool. The body of the tool may then be heated to a second temperature higher than the first temperature to sinter at least the plurality of metal matrix particles to form a layer of hardfacing material on the surface of the body of the tool that includes a plurality of hard particles dispersed throughout a metal matrix phase formed from the plurality of metal matrix particles.

BRIEF DESCRIPTION OF THE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which:

DETAILED DESCRIPTION

As used herein, the term "abrasion" refers to a three-body wear mechanism that includes two surfaces of solid materials sliding past one another with solid particulate material therebetween.

As used herein, the term "erosion" refers to a two-body wear mechanism that occurs when solid particulate material, a fluid, or a fluid carrying solid particulate material impinges on a solid surface.

As used herein, the term "fluid" comprises substances consisting solely of liquids as well as substances comprising solid particulate material suspended within a liquid, and includes conventional drilling fluid (or drilling mud), which may comprise solid particulate material such as additives, as well as formation cuttings and detritus suspended within a liquid.

As used herein, the term "hardfacing" means any material or mass of material that is applied to a surface of a separately formed body and that is more resistant to wear (abrasive wear and/or erosive wear) relative to the material of the separately formed body at the surface.

The illustrations presented herein are, in some instances, not actual views of any particular earth-boring tool, flow tube, or fluid passageway, but are merely idealized representations that are employed to describe the present invention. Additionally, elements common between figures may retain the same numerical designation.

Figure 1:
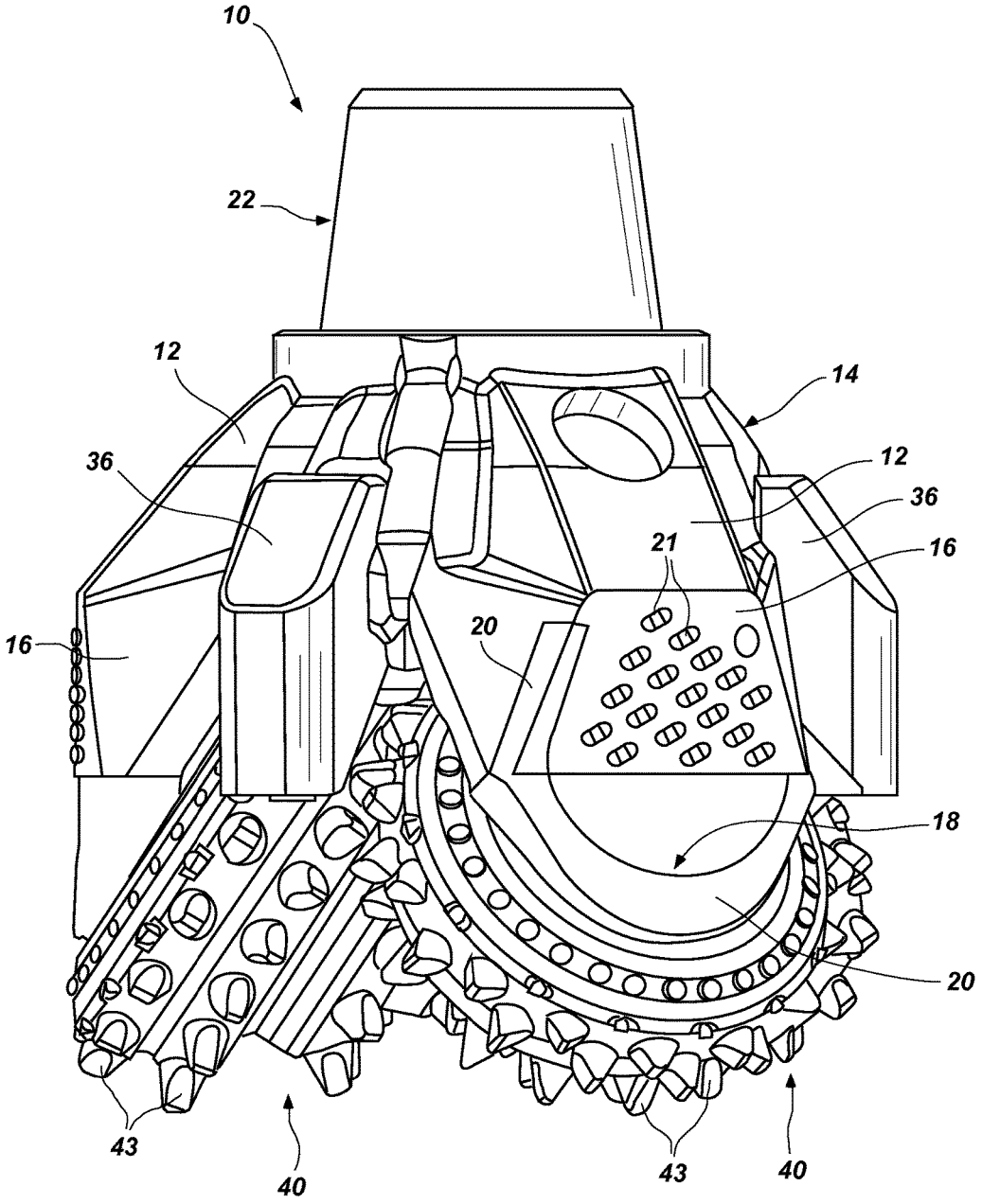
FIG. 1 illustrates an embodiment of an earth-boring rotary drill bit according to the present invention.

The present invention includes embodiments of methods of hardfacing internal surfaces of earth-boring tools, such as the drill bit 10 shown in FIG. 1, to intermediate structures formed during such methods, and to earth-boring tools formed using such methods. Broadly, the methods involve mixing together a polymer material and particles that will ultimately be used to form a hardfacing material, applying the mixture to a surface of an earth-boring tool, and heating the mixture on the earth-boring tool to remove the polymer material and sinter the particles previously mixed therewith to form a layer of hardfacing material on the surface of the tool.

FIG. 1 is a perspective side view illustrating an example of an earth-boring tool to which hardfacing may be applied in accordance with embodiments of the present invention. The earth-boring tool of FIG. 1 is a rolling cutter type rotary drill bit 10, such bits also being known in the art as "roller cone" bits as noted above, due to the generally conical shape of the rolling cutters employed in many such bits. The embodiment of the drill bit 10 shown in FIG. 1 includes three head sections 12 that are welded together to form a bit body 14 of the drill bit 10, such an arrangement being well known to those of ordinary skill in the art. Only two of the head sections 12 are visible in FIG. 1. The bit body 14 may comprise a pin 22 or other means for securing the drill bit 10 (FIG. 1) to a drill string or bottom hole assembly (not shown). In some embodiments, the pin 22 may be configured to conform to industry standards for threaded pin connections, such as those promulgated by the American Petroleum Institute (API).

A bit leg 16 extends downwardly from each of the head sections 12 of the drill bit 10 (FIG. 1). Each bit leg 16 may be integrally formed with the corresponding head section 12 from which it depends. As shown in FIG. 1, at least one of hardfacing material 20 and inserts 21 may be used to protect the outer surfaces of the bit legs 16 from wear. By way of example and not limitation, hardfacing material 20 may be applied to the rotationally leading surfaces of the bit legs 16 and to the lower surfaces or "shirttails" at the lower end 18 of the bit legs 16, and inserts 21 may be provided in or on the radially outward most surfaces of the bit legs 16, as shown in FIG. 1. The hardfacing material 20 and the inserts 21 may comprise materials that are relatively more wear-resistant relative to the material of the bit legs 16 at the surfaces thereof. In additional embodiments, the outer surfaces of the bit legs 16 may comprise only inserts 21 and no hardfacing material 20, or only hardfacing material 20 and no inserts 21. In yet further embodiments, the outer surfaces of the bit legs 16 may comprise neither hardfacing material 20 nor inserts 21.

A rolling cutter in the form of a roller cone 40 may be rotatably mounted on a bearing shaft (not shown) that extends downwardly and radially inwardly from the lower end 18 of each bit leg 16 (relative to a longitudinal centerline (not shown) of the drill bit 10 and when the drill bit 10 is oriented relative to the observer as shown in FIG. 1). The roller cones 40 are rotatably mounted on the bearing shafts such that, as the drill bit 10 is rotated at the bottom of a wellbore within an earth formation, the roller cones 40 roll and slide across the underlying formation.

Each roller cone 40 includes a plurality of cutting elements 43, which may be disposed in rows extending circumferentially about the roller cone 40, for crushing and scraping the formation as the roller cones 40 roll and slide across the formation at the bottom of the wellbore. In the embodiment shown in FIG. 1, the cutting elements 43 comprise inserts that are pressed into complementary recesses formed in the body of the roller cones 40. The inserts may comprise a relatively hard and abrasive material such as, for example, cemented tungsten carbide. In additional embodiments, the cutting elements 43 may comprise cutting teeth that are machined on or in the surface of the roller cones 40. Such cutting teeth may be coated with hardfacing material (not shown), similar to the hardfacing material 20, which may comprise, for example, a composite material including hard particles (e.g., tungsten carbide) dispersed within a metal or metal alloy matrix material (e.g., an iron-based, cobalt-based, or nickel-based alloy).

With continued reference to FIG. 1, the drill bit 10 includes three flow tubes 36 (only two of which are visible in FIG. 1). In the embodiment shown in FIG. 1, the flow tubes 36 are discrete structures that are separately formed from the head sections 12 (and integral bit legs 16) of the drill bit 10. The flow tubes 36 are attached to the bit body 14 by, for example, welding the flow tubes 36 to the bit body 14 after welding the head sections 12 together to form the bit body 14. In other embodiments, the flow tubes 36 may be welded to one or more head sections 12 prior to welding the head sections 12 together to form the bit body 14. In yet further embodiments, the flow tubes 36 may not be separately formed from the head sections 12 but, rather, may be an integral part of a head section 12.

The drill bit 10 (FIG. 1) includes internal fluid passageways (not shown in FIG. 1) that extend through the drill bit 10. The fluid passageways may each comprise, for example, an internal longitudinal bore (not shown), which may also be termed a "plenum," that extends at least partially through the pin 22. The internal longitudinal bore may diverge into a plurality of relatively smaller passageways that lead from the longitudinal bore to the exterior of the drill bit 10 (FIG. 1). Some of these passageways may lead to, and extend through, the flow tubes 36.

As previously discussed, during drilling, drilling fluid is pumped from the surface through the drill string (not shown) and the drill bit 10 (FIG. 1) to the bottom of the wellbore. The drilling fluid passes through the fluid passageways within the drill bit 10 and out from the flow tubes 36 toward the cones and/or the exposed surfaces of the subterranean formation within the wellbore. Nozzles (not shown) may be inserted within each of the flow tubes 36. The nozzles may have internal geometries designed, sized and configured to at least partially define the velocity and the direction of the drilling fluid as the drilling fluid passes through the nozzles and exits the flow tubes 36.

The present invention includes embodiments of methods of applying hardfacing material to internal and external surfaces of earth-boring tools, such as the drill bit 10 shown in FIG. 1, to intermediate structures formed during such methods, and to earth-boring tools formed using such methods. Broadly, the methods involve mixing together a polymer material and particles that will ultimately be used to form a hardfacing material, applying the mixture to a surface of an earth-boring tool, and heating the mixture on the earth-boring tool to remove the polymer material and sinter the particles previously mixed therewith to form a layer of hardfacing material on the surface of the tool.

Figure 2:
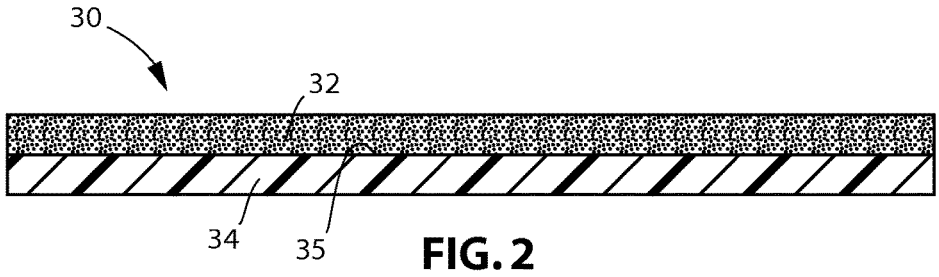
FIG. 2 is a simplified cross-sectional view of an embodiment of a multi-layer film that may be used to form a layer of hardfacing on surfaces of an earth-boring tool, such as the earth-boring rotary drill bit shown in FIG. 1.

Referring to FIG. 2, a multi-layer film 30 may be formed and applied to surfaces of an earth-boring tool such as, for example, to a bit body 14 of an earth-boring rotary drill bit 10 (FIG. 1). For example, the multi-layer film 30 may be applied to inner surfaces of a bit body 14 within fluid passageways extending therethrough to fluid nozzles and, in particular, to regions of such inner surfaces that are susceptible to erosion caused by the flow of drilling fluid through the fluid passageways. For purposes of this application, regions "susceptible to erosion" caused by the flow of drilling fluid through the flow tube or fluid passageway may be considered as those regions of a flow tube, drill bit, or other earth-boring tool that will eventually be eroded away by drilling fluid when conventional drilling fluid is caused to flow through the flow tube or fluid passageway at conventional drilling flow rates and fluid pressures for a period of time of less than about five times the average lifetime, in terms of operating hours, for the respective design or model of the drill bit or other earth-boring tool carrying the flow tube or fluid passageway. In other words, if conventional drilling fluid is caused to flow through the flow tube or fluid passageway at conventional flow rates and fluid pressures for a period of time that is about five times the average lifetime of the respective design or model of the drill bit or other earth-boring tool carrying the flow tube or fluid passageway, and a region of the flow tube, drill bit, or other earth-boring tool has eroded away, that region may be considered to be a region "susceptible to erosion" caused by the flow of drilling fluid through the flow tube or fluid passageway for purposes of this application.

By way of example and not limitation, in some embodiments, the multi-layer film 30 may comprise a flexible bilayered sheet as disclosed in U.S. Pat. No. 4,228,214 to Steigelman et al., which issued Oct. 14, 1980, the disclosure of which is incorporated herein in its entirety by this reference.

As shown in FIG. 2, the multi-layer film 30 includes a first layer 32 and at least one additional second layer 34. The first layer 32 covers at least a portion of a surface 35 of the second layer 34. Each of the first layer 32 and the second layer 34 includes a polymer material and a plurality of particles dispersed throughout the polymer material.

The polymer material of the first layer 32 may have a composition identical, or at least substantially similar, to the polymer material of the second layer 34. In additional embodiments, the polymer material of the first layer 32 may have a material composition that is different from a material composition of the polymer material of the second layer 34. One or both of the polymer material of the first layer 32 and the polymer material of the second layer 34 may comprise a thermoplastic and elastomeric material. As used herein, the term "thermoplastic material" means and includes any material that exhibits a hardness value that decreases as the temperature of the material is increased from about room temperature to about two hundred degrees Fahrenheit (200° F.). As used herein, the term "elastomeric material" means and includes a material that, when subjected to tensile loading, undergoes more non-permanent elongation deformation than permanent (i.e., plastic) elongation deformation prior to rupture. By way of example and not limitation, one or both of the polymer of the first layer 32 and the polymer of the second layer 34 may comprise at least one of styrene-butadiene-styrene, styrene-ethylene-butylene-styrene, styrene-divinylbenzene, styrene-isoprene-styrene, and styrene-ethylene-styrene. The thermoplastic elastomer may comprise a block co-polymer material having at least one end block having a molecular weight of between about 50,000 and about 150,000 grams per mole and at least one center block having a molecular weight of between about 5,000 and 25,000 grams per mole. Further, the block co-polymer material may exhibit a glass transition temperature between about 130° C. and about 200° C. In some embodiments, at least one of the polymer material of the first layer 32 and the polymer material of the second layer 34 may be identical, or at least substantially similar, to those described in U.S. Pat. No. 5,508,334, which issued Apr. 16, 1996 to Chen, the disclosure of which is incorporated herein in its entirety by this reference.

With continued reference to FIG. 2, the particles within the first layer 32 may be at least substantially comprised of hard particles. By way of example and not limitation, the particles within the first layer 32 may be at least substantially comprised of particles comprising a hard material, such as diamond, cubic boron nitride (the foregoing two materials also being known in the art as "superhard" and "superabrasive" materials), boron carbide, aluminum nitride, and carbides or borides of the group consisting of W, Ti, Mo, Nb, V, Hf, Zr, Si, Ta, and Cr.

The particles within the second layer 34 may be at least substantially comprised by particles comprising a metal or metal alloy for forming a matrix phase of hardfacing material. By way of example and not limitation, the particles within the second layer 34 may be at least substantially comprised of particles comprising cobalt, a cobalt-based alloy, iron, an iron-based alloy, nickel, a nickel-based alloy, a cobalt- and nickel-based alloy, an iron- and nickel-based alloy, an iron- and cobalt-based alloy, an aluminum-based alloy, a copper-based alloy, a magnesium-based alloy, or a titanium-based alloy.

In additional embodiments, the particles within the first layer 32 may be at least substantially comprised of particles comprising a metal or metal alloy for forming a matrix phase of hardfacing material, and the particles within the second layer 34 may be at least substantially comprised of hard particles. In yet further embodiments, both the first layer 32 and the second layer 34 may comprise hard particles and particles comprising a metal or metal alloy.

Figure 3:
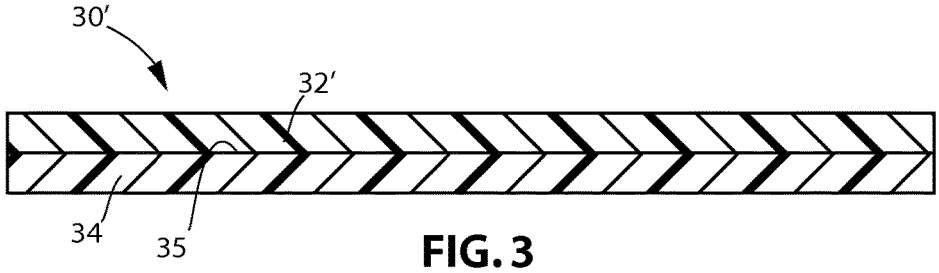
FIG. 3 is a simplified cross-sectional view of an embodiment of a multi-layer film that may be used to form a layer of hardfacing on surfaces of an earth-boring tool.

In some embodiments, one or both of the first layer 32 and the second layer 34 of the multi-layer film 30 may comprise a film of at least substantially solid material. For example, at least the second layer 34 may comprise a film of at least substantially solid material. Additionally, in some embodiments, one or both of the first layer 32 and the second layer 34 of the multi-layer film 30 may comprise a paste. By way of example and not limitation, the second layer 34 may comprise a film of at least substantially solid material, and the first layer 32 may comprise a paste that is disposed on and at least substantially covers the surface 35 of the second layer 34, as shown in FIG. 2. FIG. 3 illustrates an additional embodiment of a multi-layer film 30' of the present invention that includes a first layer 32' and a second layer 34. The multi-layer film 30' is substantially similar to the multi-layer film 30 of FIG. 2, except that the first layer 32' of the multi-layer film 30' comprises a solid film, similar to that of the second layer 34.

Figure 4:
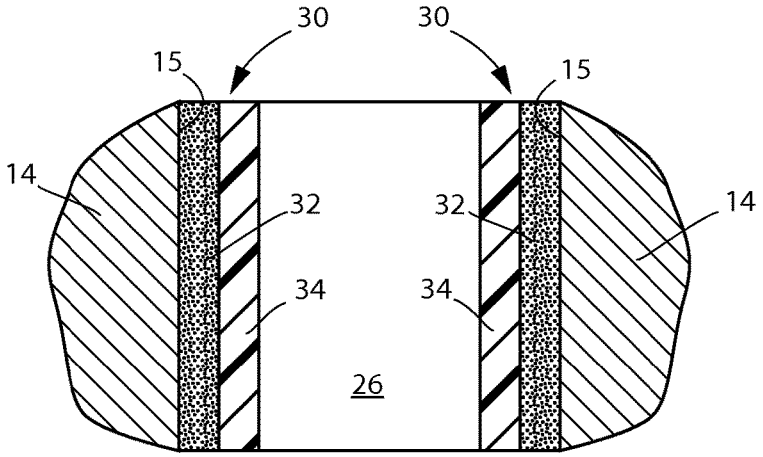
FIG. 4 is a partial cross-sectional view of a body of an earth-boring tool illustrating a multi-layer film like that shown in FIG. 2 on a surface within a fluid passageway extending through the body of the earth-boring tool.

FIG. 4 illustrates the multi-layer film 30 of FIG. 2 applied to a surface 15 of the bit body 14 of the drill bit 10 (FIG. 1) to which it is desired to apply a hardfacing material such that the paste of the first layer 32 is disposed between the surface 15 of the bit body 14 of the drill bit 10 and the second layer 34 of the multi-layer film 30. In other words, the paste of the first layer 32 may be disposed over at least a portion of a surface 15 of the bit body 14 of the drill bit 10, and the second layer 34 may be disposed over at least a portion of the first layer 32 on a side thereof opposite the surface 15 of the bit body 14 of the earth-boring rotary drill bit 10. The paste may be used to hold or adhere the multi-layer film 30 to the surface of the earth-boring tool until the earth-boring tool and the multi-layer film 30 are heated to form a hardfacing material from the multi-layer film 30, as described in further detail below. In some embodiments, the surface 15 of the bit body 14 of the earth-boring rotary drill bit 10 may comprise a surface 15 within a fluid passageway 26 extending at least partly through the bit body 14 of the earth-boring rotary drill bit 10, as shown in FIG. 4.

Figure 5:
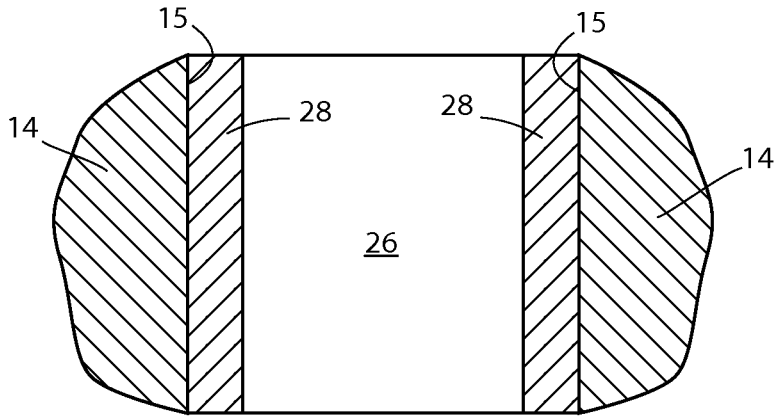
FIG. 5 is a partial cross-sectional view of a portion of the body of the earth-boring tool shown in FIG. 4 illustrating a layer of hardfacing material formed from the multi-layer film.

FIG. 5 is a partial cross-sectional view of the portion of the bit body 14 of the earth-boring rotary drill bit 10 shown in FIG. 4, further illustrating a layer of hardfacing material 28 formed from a multi-layer film 30, 30' or paste, as previously described herein, on the surface 15 of the bit body 14 within a fluid passageway 26. By way of example and not limitation, the hardfacing material 28 may comprise a composite material having a relatively hard first phase distributed within a second, continuous metal or metal alloy matrix phase.

By way of example and not limitation, the first phase may comprise a hard material such as diamond, boron carbide, cubic boron nitride, aluminum nitride, and carbides or borides of the group consisting of W, Ti, Mo, Nb, V, Hf, Zr, Si, Ta, and Cr, and the metal matrix phase may comprise cobalt, a cobalt-based alloy, iron, an iron-based alloy, nickel, a nickel-based alloy, a cobalt- and nickel-based alloy, an iron- and nickel-based alloy, an iron- and cobalt-based alloy, an aluminum-based alloy, a copper-based alloy, a magnesium-based alloy, or a titanium-based alloy. In some embodiments, the first phase may comprise a plurality of discrete regions or particles dispersed within the metal or metal alloy matrix phase.

In some embodiments, the hardfacing material 28 may comprise a hardfacing composition as described in U.S. Pat. No. 6,248,149, which issued Jun. 19, 2001 and is entitled "Hardfacing Composition for Earth-Boring Bits Using Macrocrystalline Tungsten Carbide and Spherical Cast Carbide," or in U.S. Pat. No. 7,343,990, which issued Mar. 18, 2008 and is entitled "Rotary Rock Bit with Hardfacing to Reduce Cone Erosion," the disclosure of each of which is incorporated herein in its entirety by this reference.

In some embodiments, the multi-layer films 30, 30' (FIGS. 2 and 3) used to form the hardfacing material 28 may be formed in situ on the surface 15 (FIG. 4) of the bit body 14 of the drill bit 10 (FIG. 1), while in other embodiments, the multi-layer films 30, 30' may be separately formed and subsequently applied to the surface 15. Methods for forming the multi-layer films 30 and 30' are described in further detail below.

Particles that will be used to form hardfacing material 28 (FIG. 5) (i.e., hard particles and/or particles comprising a metal or metal alloy matrix material) may be mixed with one or more polymer materials and one or more solvents to form a paste or slurry.

The one or more polymer materials may comprise a thermoplastic and elastomeric polymer material, as previously mentioned. For example, at least one of styrene-butadiene-styrene, styrene-ethylene-butylene-styrene, styrene-divinylbenzene, styrene-isoprene-styrene, and styrene-ethylene-styrene may be mixed with the particles and the solvent to form the paste or slurry.

The slurry may comprise one or more plasticizers, in addition to the polymer material, for selectively modifying the deformation behavior of the polymer material. The plasticizers may be, or include, light oils (such as paraffinic and naphthenic petroleum oils), polybutene, cyclobutene, polyethylene (e.g., polyethylene glycol), polypropene, an ester of a fatty acid or an amide of a fatty acid.

The solvent may comprise any substance in which the polymer material can at least partially dissolve. For example, the solvent may comprise methyl ethyl ketone, alcohols, toluene, hexane, heptane, propyl acetate, and trichloroethylene, or any other conventional solvent.

The slurry also may comprise one or more stabilizers for aiding suspension of the one or more polymer materials in the solvent. Suitable stabilizers for various combinations of polymers and solvents are known to those of ordinary skill in the art.

After forming the paste or slurry, the paste or slurry may be applied as a relatively thin layer on a surface of a substrate using, for example, a tape casting process. The solvent then may be allowed to evaporate from the paste or slurry to form a relatively solid layer of polymer material in which the hard particles and/or particles comprising a metal or metal alloy matrix material are embedded. For example, the paste or slurry may be heated on a substantially planar surface of a drying substrate after tape casting to a temperature sufficient to evaporate the solvent from the paste or slurry. The paste or slurry may be dried under a vacuum to decrease drying time and to eliminate any vapors produced during the drying process.

To form the multi-layer film 30 shown in FIG. 2, a slurry may be formed by mixing particles comprising a metal or metal alloy matrix material with one or more polymer materials and one or more solvents, and the slurry may be tape cast and dried to form the second layer 34 of the multi-layer film 30. After forming the second layer 34, a paste may be formed by mixing hard particles with one or more polymer materials and one or more solvents, and the paste may be applied to a major surface 35 of the second layer 34 such that the major surface 35 of the second layer 34 is at least substantially coated with the paste to form the first layer 32 of the multi-layer film 30.

To form the multi-layer film 30' shown in FIG. 3, a first slurry may be formed by mixing particles comprising a metal or metal alloy matrix material with one or more polymer materials and one or more solvents, and the first slurry may be tape cast and dried to form the second layer 34 of the multi-layer film 30', as previously discussed. After forming the second layer 34, a second slurry may be formed by mixing hard particles with one or more polymer materials and one or more solvents, and the second slurry may be tape cast and dried over a major surface 35 of the second layer 34 to form the first layer 32' of the multi-layer film 30'. In other embodiments, the first layer 32' and the second layer 34 may be separately formed in separate tape casting and drying processes and subsequently laminated together to form the multi-layer film 30' by, for example, placing the first layer 32' and the second layer 34 adjacent one another and passing them together between pressure rollers.

In additional embodiments, a paste formed by mixing hard particles and particles comprising a metal or metal alloy matrix material with one or more polymer materials and one or more solvents (and, optionally, plasticizers, etc.) may be applied directly to the surface 15 of the bit body 14 of the drill bit 10 to which hardfacing material 28 (FIG. 5) is to be applied, and hardfacing material 28 may be formed from the paste as subsequently described herein.

After forming the multi-layer film 30, 30', the multi-layer film 30, 30' may be applied to the surface 15 of the bit body 14 of the drill bit 10 (FIG. 1) to which hardfacing material 28 is to be applied (if the multi-layer film 30, 30' was not formed in situ on the surface 15 of the bit body 14). If the multi-layer film 30, 30' will not stick to the surface 15 of the bit body 14 by itself, an adhesive may be provided between the multi-layer film 30, 30' and the surface 15 of the bit body 14 to adhere the multi-layer film 30, 30' to the surface 15 of the bit body 14. The multi-layer film 30, 30' may be cut or otherwise formed to have a desired shape complementary to a surface 15 to which it is to be applied. For example, the multi-layer film 30, 30' may be cut or otherwise formed to have a shape complementary to an inner surface of an earth-boring tool within a fluid passageway extending therethrough.

The bit body 14 of the earth-boring rotary drill bit 10 (FIG. 1), together with the multi-layer film 30, 30' or paste on one or more surfaces 15 thereof, then may be heated in a furnace to form a hardfacing material 28 on the surface 15 of the bit body 14 from the multi-layer film 30, 30' or paste. Upon heating the multi-layer film 30, 30' or paste to temperatures of between about 150° C. and about 500° C., organic materials within the multi-layer film 30, 30' or paste may volatize and/or decompose, leaving behind the inorganic components of the multi-layer film 30, 30' or paste on the surface 15 of the bit body 14. For example, the multi-layer film 30, 30' or paste may be heated at a rate of about 2° C. per minute to a temperature of about 450° C. to cause organic materials (including polymer materials) within the multi-layer film 30, 30' or paste to volatilize and/or decompose.

After heating the multi-layer film 30, 30' or paste to volatilize and/or decompose organic materials therein, the remaining inorganic materials of the multi-layer film 30, 30' or paste may be further heated to a relatively higher sintering temperature to sinter the inorganic components and form a hardfacing material 28 therefrom. For example, the remaining inorganic materials of the multi-layer film 30, 30' or paste may be further heated at a rate of about 15° C. per minute to a sintering temperature of about 1150° C. The sintering temperature may be proximate a melting temperature of the metal or metal alloy matrix material of the matrix particles in the multi-layer film 30, 30' or paste. For example, the sintering temperature may be slightly below, slightly above, or equal to a melting temperature of the metal or metal alloy matrix material.

The volatilization and/or decomposition process, as well as the sintering process, may be carried out under vacuum (i.e., in a vacuum furnace), in an inert atmosphere (e.g., nitrogen, argon, helium, or another at least substantially inert gas), or in a reducing atmosphere (e.g., hydrogen).

During the sintering process, at least the particles comprising a metal or metal alloy matrix material may condense and coalesce to form an at least substantially continuous metal or metal alloy matrix phase in which a discontinuous hard phase formed from the hard particles is distributed. In other words, during sintering, the hard particles may become embedded within a layer of metal or metal alloy matrix material formed from the particles comprising the metal or metal alloy matrix material. During the sintering process, the metal or metal alloy matrix material within the second layer 34 of the multi-layer film 30, 30' may be wicked into the first layer 32, 32' between the hard particles therein. As the bit body 14 of the earth-boring rotary drill bit 10 (FIG. 1) is cooled, the metal or metal alloy matrix material bonds to the surface 15 of the bit body 14 and holds the hard particles in place on the surface 15 of the bit body 14.

In some embodiments, the multi-layer film 30, 30' or paste may have an average thickness and composition such that, upon sintering, the resulting layer of hardfacing material 28 formed on the surface 15 of the bit body 14 of an earth-boring tool has an average thickness of between about 1.25 millimeters (0.05 inch) and about 12 millimeters (0.5 inch).

Figure 6A:
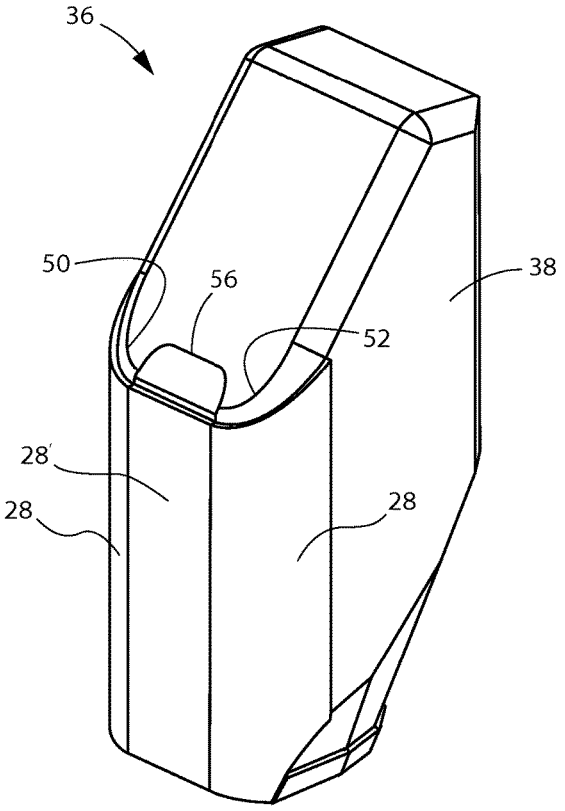
FIG. 6A is an isometric view of an embodiment of a flow tube according to the present invention that may be used with earth-boring tools, such as the rotary drill bit shown in FIG. 1.
Figure 6B:
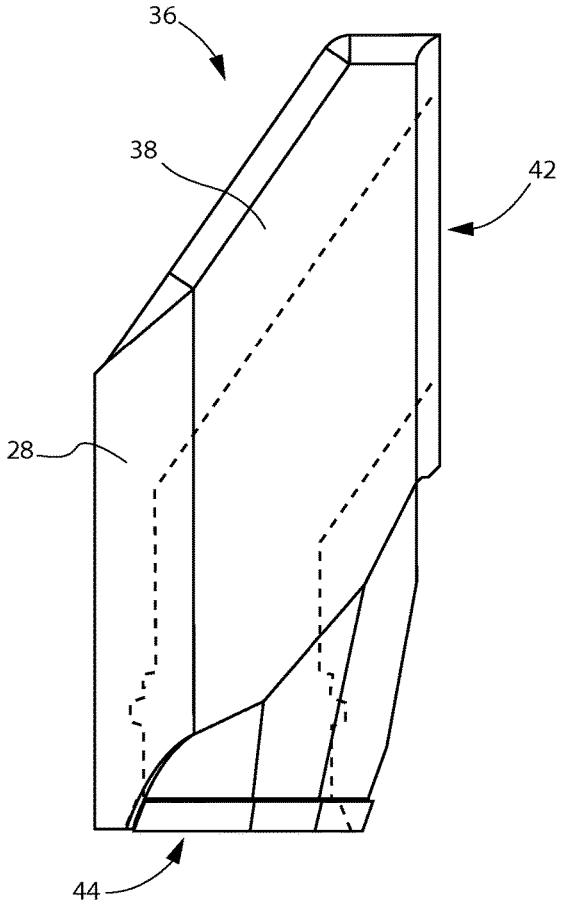
FIG. 6B is a side view of the flow tube shown in FIG. 6A.
Figure 6C:
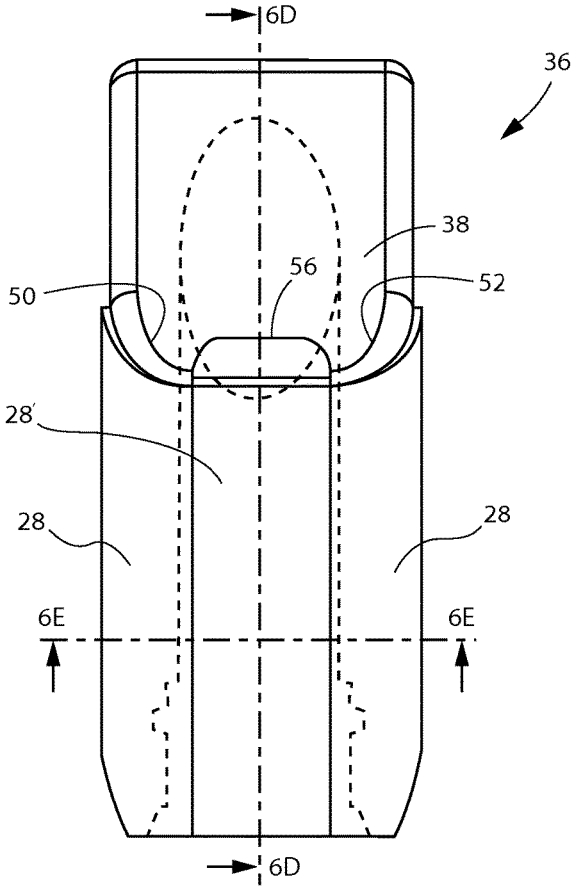
FIG. 6C is a front view of the flow tube shown in FIGS. 6A and 6B.

As previously mentioned, embodiments of methods of the present invention may be used to apply hardfacing materials to surfaces of earth-boring tools within fluid passageways extending at least partly therethrough. Such fluid passageways may extend, for example, through a bit body of an earth-boring rotary drill bit and/or through a flow tube on a bit body of an earth-boring rotary drill bit. FIGS. 6A-6F illustrate an example of a flow tube 36 to which hardfacing material 28 may be applied in accordance with embodiments of the present invention. FIG. 6A is an isometric view of the flow tube 36, FIG. 6B is a side view of the flow tube 36, and FIG. 6C is a front view of the flow tube 36.

Figure 6D:
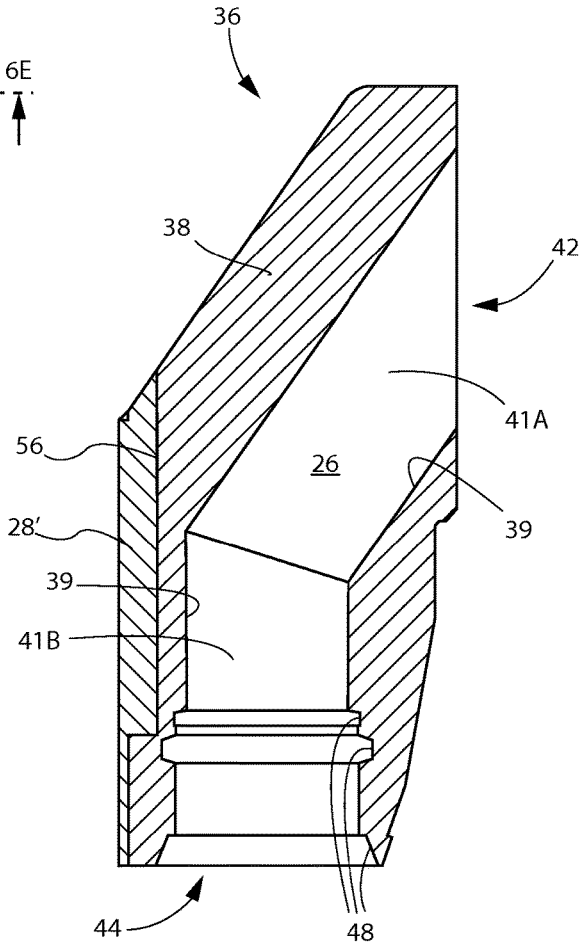
FIG. 6D is a longitudinal cross-sectional view of the flow tube shown in FIGS. 6A-6C taken along section line 6D-6D shown in FIG. 6C.

Referring to FIG. 6A, the flow tube 36 includes a tube body 38, which may comprise a metal or metal alloy such as, for example, steel. As shown in FIG. 6D, which is a longitudinal cross-sectional view of the flow tube 36 taken along section line 6D-6D shown in FIG. 6C, a fluid passageway 26 extends through the tube body 38 of the flow tube 36 from an inlet 42 to an outlet 44. Drilling fluid flows through the fluid passageway 26 from the inlet 42 to the outlet 44 during drilling. Annular recesses 48 or other geometric features (e.g., threads) may be machined or otherwise provided in inner walls 39 of the tube body 38 within the fluid passageway 26 proximate the outlet 44 to receive and secure a nozzle and any associated seals (e.g., O-rings) and retention rings therein.

Referring again to FIG. 6A, hardfacing material 28 may be applied to one or both of a rotationally leading outer edge 50 and a rotationally trailing outer edge 52 of the tube body 38. Furthermore, hardfacing material 28 may be applied to exterior surfaces of the tube body 38 of the flow tube 36 over regions that are proximate to, or adjacent, regions of the inner walls 39 (FIG. 6D) of the tube body 38 that are susceptible to erosion caused by the flow of drilling fluid through the flow tube 36.

Referring to FIG. 6D, a first section 41A of the fluid passageway 26 extends through the flow tube 36 in a first direction from the inlet 42 in a radially outward and downward direction (relative to a longitudinal centerline of the drill bit 10 when the flow tube 36 is secured to the drill bit 10 and the drill bit 10 is oriented relative to the observer as shown in FIG. 1). The first section 41A of the fluid passageway 26 transitions to a second section 41B of the fluid passageway 26 that extends in a generally downward direction to the outlet 44. In the embodiment shown in FIGS. 6A-6E, the first section 41A of the fluid passageway 26 is oriented at an obtuse angle (i.e., between 90° and 180°) relative to the second section 41B of the fluid passageway 26. In this configuration, as drilling fluid passes from the first section 41A into the second section 41B of the fluid passageway 26, the drilling fluid may impinge on the radially outward regions of the inner walls 39 of the tube body 38 within the second section 41B at an acute angle of less than ninety degrees (90°). As a result, the radially outward regions of the inner walls 39 of the tube body 38 within the second section 41B of the fluid passageway 26 may be more susceptible to erosion caused by the passage of drilling fluid through the fluid passageway 26 relative to other regions of the inner walls 39 of the tube body 38.

To reduce damage to the flow tube 36 caused by such erosion, a relatively thick layer of hardfacing material 28' may be applied to the regions of the outer surfaces of the tube body 38 of the flow tube 36 that are adjacent the regions of the inner walls 39 of the tube body 38 that are susceptible to erosion, as shown in FIGS. 6A-6E. The relatively thick layer of hardfacing material 28' may be configured in the form of an elongated strip extending down and covering the radially outermost regions of the outer surfaces of the tube body 38 of the flow tube 36 (relative to the longitudinal centerline of the drill bit 10 (FIG. 1)), as best shown in FIGS. 6A and 6C.

In using the hardfacing material 28' to reduce damage to the flow tube 36 caused by erosion of the inner walls 39 of the tube body 38, it may be desirable to configure the relatively thick layer of hardfacing material 28' to have a thickness that is greater than a thickness of hardfacing material 28 used to prevent or reduce abrasive wear to exterior surfaces of the flow tube 36, such as the hardfacing material 28 applied to the rotationally leading and trailing outer edges 50, 52 of the tube body 38 of the flow tube 36. By way of example and not limitation, the relatively thick layer of hardfacing material 28' may have an average thickness of greater than about 5.0 millimeters (greater than about 0.2 inch), and the hardfacing material 28 applied to the rotationally leading and trailing outer edges 50, 52 of the flow tube 36 may have an average thickness of less than about 4.5 millimeters (less than about 0.18 inch). As one particular non-limiting example, the relatively thick layer of hardfacing material 28' may have an average thickness of between about 6.9 millimeters (about 0.27 inch) and about 8.2 millimeters (about 0.32 inch), and the hardfacing material 28 applied to the rotationally leading and trailing outer edges 50, 52 of the flow tube 36 may have an average thickness of between about 0.8 millimeters (about 0.03 inch) and about 1.6 millimeters (about 0.06 inch).

Figure 6E:
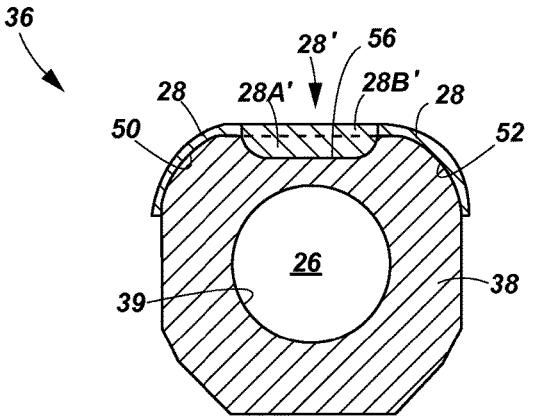
FIG. 6E is a transverse cross-sectional view of the flow tube shown in FIGS. 6A-6D taken along section line 6E-6E shown in FIG. 6C.

In some embodiments, it may be desirable to configure the exterior surface of the relatively thick layer of hardfacing material 28' and the exterior surfaces of the hardfacing material 28 applied to the rotationally leading and trailing outer edges 50, 52 of the flow tube 36 to be substantially flush with one another, as shown in FIG. 6A. To enable the exterior surface of the hardfacing material 28' and the hardfacing material 28 to be substantially flush with one another, the layer of hardfacing material 28' may be at least partially disposed within a recess 56 provided in an outer surface of the tube body 38 of the flow tube 36, as shown in FIGS. 6A, 6C, 6D, and 6E. Referring to FIGS. 6D and 6E, in some embodiments, the recess 56 may be configured as a groove that extends in a downward direction along the outer surface of the tube body 38. As one non-limiting example, the recess 56 may extend into the outer surface of the tube body 38 to a depth of between about 5.0 millimeters (about 0.20 inch) and about 13.0 millimeters (about 0.50 inch). More particularly, the recess 56 may extend into the outer surface of the tube body 38 to a depth of between about 6.1 millimeters (about 0.24 inch) and about 6.6 millimeters (about 0.26 inch).

Figure 6F:
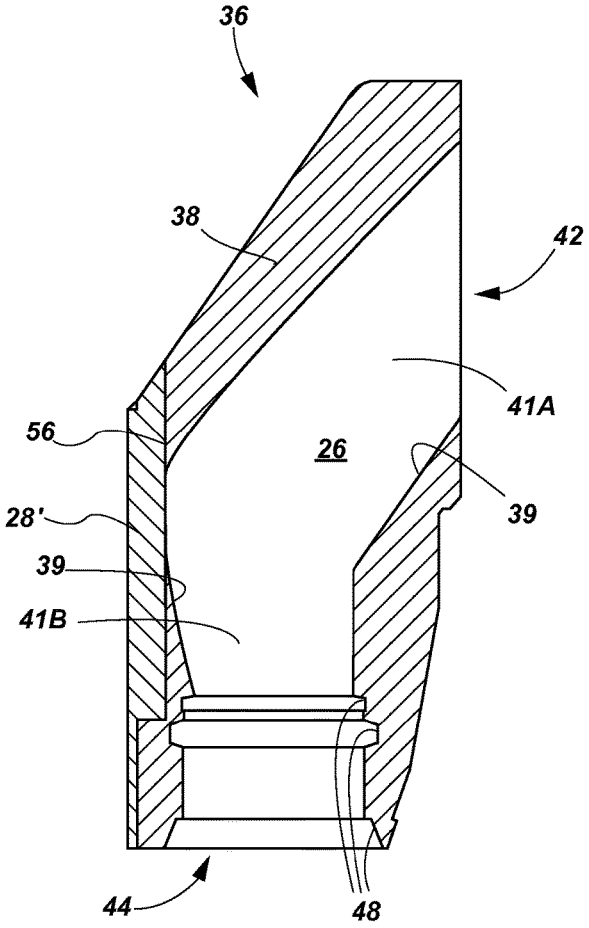
FIG. 6F is a longitudinal cross-sectional view (like that of FIG. 6D) of the flow tube shown in FIGS. 6A-6E illustrating erosion of the interior walls of the flow tube that may occur during drilling due to the flow of drilling fluid through the flow tube.

FIG. 6F is a longitudinal cross-sectional view of the flow tube 36, like that of FIG. 6D, illustrating erosion of the inner walls 39 of the tube body 38 of the flow tube 36 that may occur after causing drilling fluid to flow through the flow tube 36 for a period of time during drilling. As shown in FIG. 6F, the inner walls 39 of the tube body 38 within the fluid passageway 26 may erode until the relatively thick layer of hardfacing material 28' is exposed within the fluid passageway 26. The hardfacing material 28' may wear due to erosion at a rate that is lower than the rate at which the material of the tube body 38 of the flow tube 36 wears due to erosion. Therefore, the hardfacing material 28' may prevent the drilling fluid from eroding entirely through the walls of the flow tube 36 from the interior fluid passageway 26 as quickly as in previously known flow tubes, thereby allowing embodiments of flow tubes 36 of the present invention to properly function for longer periods of time and through the operational life of the drill bit 10 (FIG. 1).

In some embodiments, the hardfacing material 28 and the hardfacing material 28' may have identical or similar compositions. In other embodiments, however, the material composition of the hardfacing material 28 may differ from the material composition of the hardfacing material 28'. For example, in the embodiment described above with reference to FIGS. 6A-6F, the hardfacing material 28 applied to the rotationally leading and trailing outer edges 50, 52 of the flow tube 36 may be intended primarily to reduce wear caused by abrasion, while at least a portion of the hardfacing material 28' may be intended primarily to reduce wear caused by erosion. Abrasion and erosion are two different wear mechanisms, and some material compositions have better resistance to abrasive wear, while other material compositions have better resistance to erosive wear. Therefore, the hardfacing material 28' may have a material composition that exhibits increased erosion resistance relative to the hardfacing material 28, while the hardfacing material 28 may have a material composition that exhibits increased abrasion resistance relative to the hardfacing material 28' in some embodiments of the present invention.

Referring to FIG. 6E, in some embodiments, the relatively thick layer of hardfacing material 28' optionally may comprise a multi-layer structure having different layers that exhibit one or more differing physical properties. By way of example and not limitation, the relatively thick layer of hardfacing material 28' may comprise a radially inward first layer 28A' having a material composition tailored to exhibit enhanced resistance to erosion, and a radially outward second layer 28B' having a material composition tailored to exhibit enhanced resistance to abrasion. In other words, the first layer 28A' may exhibit an erosion resistance that is greater than an erosion resistance exhibited by the second layer 28B', and the second layer 28B' may exhibit an abrasion resistance that is greater than an abrasion resistance that is exhibited by the first layer 28A'. As one particular non-limiting example, the first layer 28A' of the hardfacing material 28' may substantially fill the recess 56 formed in the outer surface of the tube body 38 of the flow tube 36, and the second layer 28B' of the hardfacing material 28' may have a material composition identical to that of the hardfacing material 28 applied to the rotationally leading and trailing outer edges 50, 52 of the flow tube 36. Furthermore, the second layer 28B' of the hardfacing material 28' may be integrally formed with the hardfacing material 28 applied to the rotationally leading and trailing outer edges 50, 52 of the flow tube 36.

Figure 7A:
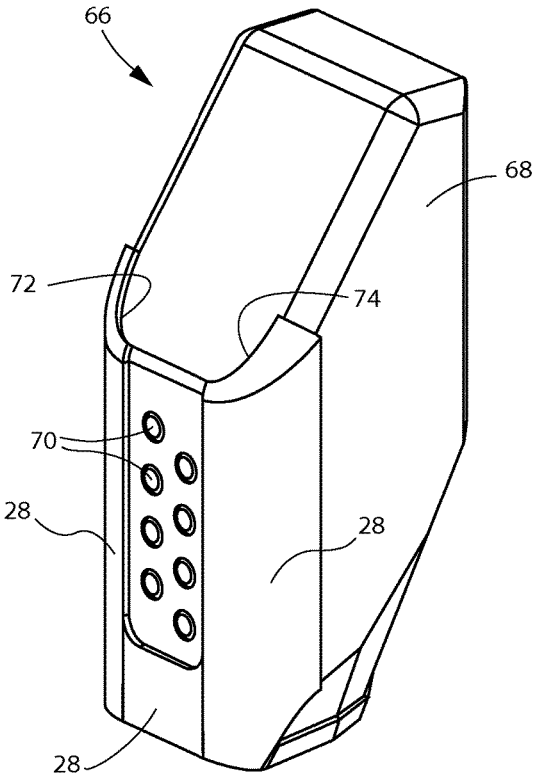
FIG. 7A is an isometric view of another embodiment of a flow tube according to the present invention that may be used with earth-boring tools, such as the rotary drill bit shown in FIG. 1.
Figure 7B:
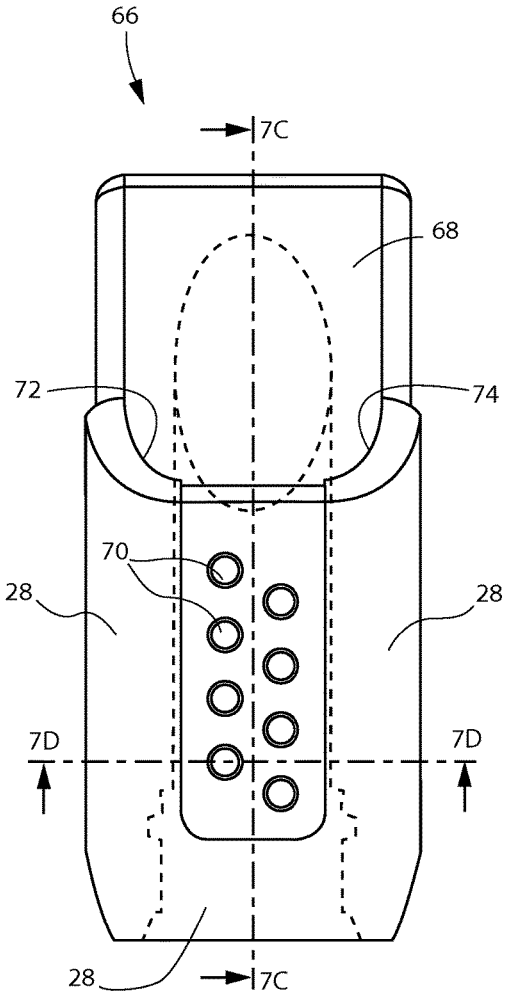
FIG. 7B is a front view of the flow tube shown in FIG. 7A.
Figure 7C:
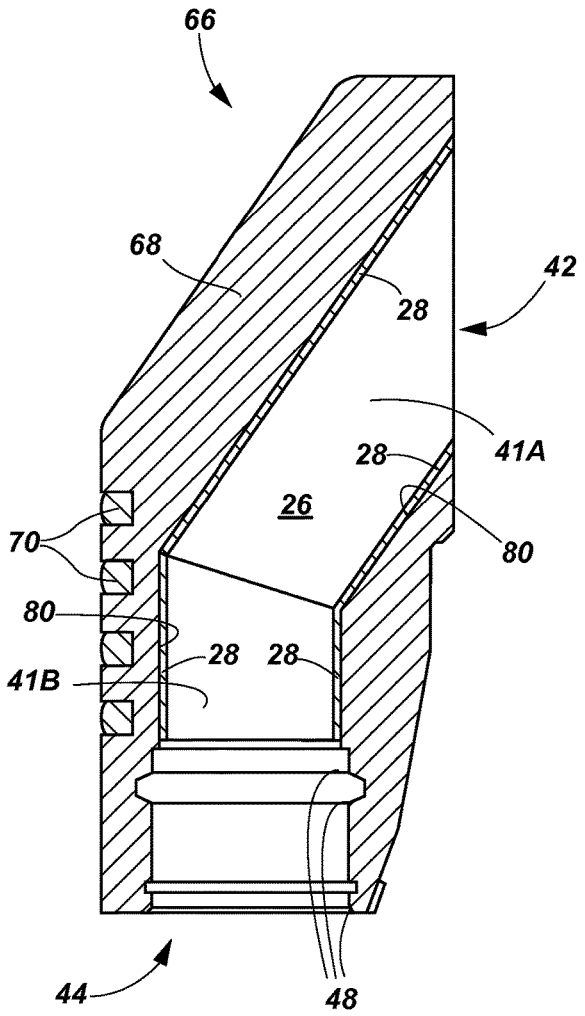
FIG. 7C is a longitudinal cross-sectional view of the flow tube shown in FIGS. 7A-7B taken along section line 7C-7C shown in FIG. 7B.
Figure 7D:
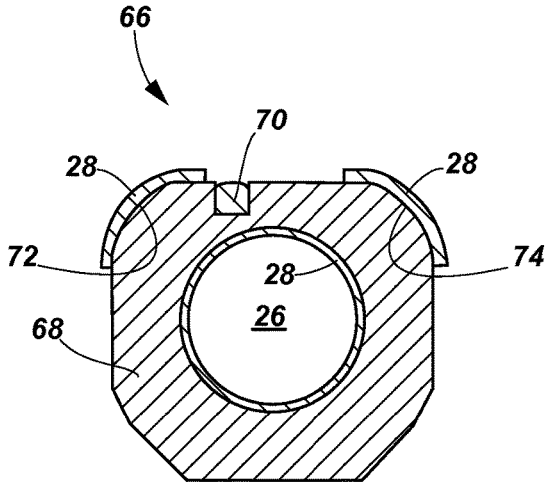
FIG. 7D is a transverse cross-sectional view of the flow tube shown in FIGS. 7A-7C taken along section line 7D-7D shown in FIG. 7B.

FIGS. 7A-7D illustrate another example embodiment of a flow tube 66 having surfaces to which a hardfacing material may be applied in accordance with embodiments of the present invention. FIG. 7A is an isometric view of the flow tube 66 and FIG. 7B is a front view of the flow tube 66. FIG. 7C is a longitudinal cross-sectional view of the flow tube 66 taken along section line 7C-7C of FIG. 7B, and FIG. 7D is a transverse cross-sectional view of the flow tube 66 taken along section line 7D-7D of FIG. 7B.

Referring to FIG. 7A, the flow tube 66 includes a tube body 68 that is generally similar to the previously described tube body 38 of the flow tube 36 shown in FIG. 6A, and includes a fluid passageway 26 that extends through the tube body 68 of the flow tube 66 from an inlet 42 to an outlet 44 (FIG. 7C). Furthermore, hardfacing material 28 may be applied to rotationally leading and trailing outer edges 72, 74 of the flow tube 66. The tube body 68 of the flow tube 66, however, may not include a recess 56 (FIG. 6A), and the flow tube 66 may include a plurality of wear-resistant inserts 70 instead of a relatively thick layer of hardfacing material 28', as previously described with reference to the flow tube 36. The wear-resistant inserts 70 may be effective at reducing abrasive wear to the outer surface of the tube body 68 of the flow tube 66. The wear-resistant inserts 70, however, may be relatively less effective (relative to the previously described layer of hardfacing material 28' (FIG. 6D)) at reducing erosive wear to the tube body 68 caused by the flow of drilling fluid through the fluid passageway 26.

Referring to FIG. 7C, a hardfacing material 28 may be applied to at least a portion of the inner walls 80 of the tube body 68 within the fluid passageway 26. The hardfacing material 28 may be used to reduce erosive wear to the tube body 68 caused by the flow of drilling fluid through the fluid passageway 26. In some embodiments, the hardfacing material 28 may be applied to and cover substantially all of the inner walls 80 of the tube body 68 of the flow tube 66 that are exposed within the fluid passageway 26 after securing a nozzle (not shown) therein. In other embodiments, the hardfacing material 28 may be applied only to regions of the inner walls 80 that are susceptible to erosion, such as the regions of the inner walls 80 at which drilling fluid will impinge on the inner walls 80 at acute angles as drilling fluid is pumped through the flow tube 66.

By way of example and not limitation, the layer of hardfacing material 28 applied to the inner walls 80 of the tube body 68 may have an average thickness of between about 1.25 millimeters (0.05 inch) and about 20 millimeters (0.8 inch). The hardfacing material 28 may have a material composition tailored to exhibit enhanced erosion resistance.

In additional embodiments of the invention, flow tubes may be provided that include both a relatively thick layer of hardfacing material 28' as previously disclosed in relation to FIGS. 6A-6F and a hardfacing material 28 applied to at least a portion of an inner wall of a body within a fluid passageway, as previously disclosed in relation to FIGS. 7A-7D.

Although the flow tube 36 previously described in relation to FIGS. 6A-6F and the flow tube 66 previously described in relation to FIGS. 7A-7D are illustrated as comprising separate bodies that are attached to a bit body (or one bit leg or bit head section of a bit body) by, for example, welding, additional embodiments of the present invention may comprise flow tubes that are integrally formed with (and are an integral portion of) a bit body (or one bit leg or a bit head section of a bit body), as well as earth-boring tools having such integrally formed flow tubes or fluid passageways.

While the present invention has been described herein with respect to certain illustrated embodiments, those of ordinary skill in the art will recognize and appreciate that it is not so limited. Rather, many additions, deletions and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, the invention has utility with different and various bit profiles as well as cutting element types and configurations.

What is claimed is:

1. A multi-layer film for use in forming a layer of hardfacing on a surface of a tool, comprising:
- a first layer comprising:
  - a first block co-polymer; and
  - a plurality of hard particles dispersed throughout the first block co-polymer; and
- a second layer covering at least a portion of a surface of the first layer, the second layer comprising:
  - a second block co-polymer; and
  - a plurality of metallic matrix particles dispersed throughout the second block co-polymer;
- wherein at least one of the first block co-polymer and the second block co-polymer exhibits a glass transition temperature of between about 130° C. and about 200° C.

2. The multi-layer film of claim 1, wherein the first block co-polymer and the second block co-polymer have at least substantially similar compositions.

3. The multi-layer film of claim 1, wherein at least one of the first block co-polymer and the second block co-polymer comprises a thermoplastic and elastomeric material.

4. The multi-layer film of claim 1, wherein at least one of the first block co-polymer and the second block co-polymer comprises at least one of styrene-butadiene-styrene, styrene-ethylene-butylene-styrene, styrene-divinylbenzene, styrene-isoprene-styrene, and styrene-ethylene-styrene.

5. The multi-layer film of claim 1, wherein at least one of the first layer and the second layer comprises a film of at least substantially solid material.

6. A multi-layer film for use in forming a layer of hardfacing on a surface of a tool, comprising:
- a first layer comprising:
  - a first block co-polymer; and
  - a plurality of hard particles dispersed throughout the first block co-polymer; and
- a second layer covering at least a portion of a surface of the first layer, the second layer comprising:
  - a second block co-polymer; and
  - a plurality of metallic matrix particles dispersed throughout the second block co-polymer;
- wherein at least one of the first block co-polymer and the second block co-polymer comprises at least one of styrene-butadiene-styrene, styrene-ethylene-butylene-styrene, styrene-divinylbenzene, styrene-isoprene-styrene, and styrene-ethylene-styrene; and
- wherein at least one of the first block co-polymer and the second block co-polymer further comprises at least one material selected from the group consisting of paraffinic petroleum oils, naphthenic petroleum oils, polybutene, cyclobutene, polyethylene, polyethylene glycol, polypropene, esters of fatty acids, and amides of fatty acids.

7. A multi-layer film for use in forming a layer of hardfacing on a surface of a tool, comprising:
- a first layer comprising:
  - a first block co-polymer; and
  - a plurality of hard particles dispersed throughout the first block co-polymer; and
- a second layer covering at least a portion of a surface of the first layer, the second layer comprising:
  - a second block co-polymer; and
  - a plurality of metallic matrix particles dispersed throughout the second block co-polymer;
- wherein at least one of the first layer and the second layer comprises a film of at least substantially solid material; and
- wherein one of the first layer and the second layer comprises a paste.

8. An intermediate structure formed during fabrication of an earth-boring tool, comprising:
- a body of an earth-boring tool;

a first material layer disposed over at least a portion of a surface of the body, the first material layer comprising:
a first block co-polymer; and
a plurality of hard particles dispersed throughout the first block co-polymer; and a second material layer disposed over at least a portion of the first material layer on a side thereof opposite the body, the second material layer comprising:
a second block co-polymer; and
a plurality of metallic matrix particles dispersed throughout the second block co-polymer;

wherein at least one of the first block co-polymer and the second block co-polymer exhibits a glass transition temperature of between about 130° C. and about 200° C.

9. The intermediate structure of claim 8, wherein each of the first material layer and the second material layer comprises a film of solid material.

10. The intermediate structure of claim 8, wherein the at least a portion of the surface of the body comprises a surface of a body of an earth-boring rotary drill bit within a fluid passageway extending at least partially through the body of the earth-boring rotary drill bit.

11. The intermediate structure of claim 8, wherein at least one of the first block co-polymer and the second block co-polymer comprises a thermoplastic and elastomeric material.

12. The intermediate structure of claim 8, wherein the plurality of hard particles comprises substantially all particles in the first material layer.

13. An intermediate structure formed during fabrication of an earth-boring tool, comprising:
a body of an earth-boring tool;
a first material layer disposed over at least a portion of a surface of the body, the first material layer comprising:
a first block co-polymer; and
a plurality of hard particles dispersed throughout the first block co-polymer; and a second material layer disposed over at least a portion of the first material layer on a side thereof opposite the body, the second material layer comprising:
a second block co-polymer; and
a plurality of metallic matrix particles dispersed throughout the second block co-polymer;

wherein the first material layer comprises a layer of paste, and the second material layer comprises a film of solid material.

14. An intermediate structure formed during fabrication of an earth-boring tool, comprising:
a body of an earth-boring tool;
a first material layer disposed over at least a portion of a surface of the body, the first material layer comprising:
a first block co-polymer; and
a plurality of hard particles dispersed throughout the first block co-polymer; and a second material layer disposed over at least a portion of the first material layer on a side thereof opposite the body, the second material layer comprising:
a second block co-polymer; and
a plurality of metallic matrix particles dispersed throughout the second block co-polymer;

wherein at least one of the first block co-polymer and the second block co-polymer comprises at least one end block having a molecular weight between about 50,000 and about 150,000 grams per mole and at least one center block having a molecular weight of between about 5,000 and about 25,000 grams per mole.

15. A multi-layer film for use in forming a layer of hardfacing on a surface of a tool, comprising:
a first layer comprising:
a first block co-polymer; and
a plurality of hard particles dispersed throughout the first block co-polymer; and a second layer covering at least a portion of a surface of the first layer, the second layer comprising:
a second block co-polymer; and
a plurality of metallic matrix particles dispersed throughout the second block co-polymer;

wherein at least one of the first block co-polymer and the second block co-polymer comprises at least one end block having a molecular weight between about 50,000 and about 150,000 grams per mole and at least one center block having a molecular weight of between about 5,000 and about 25,000 grams per mole.

* * * * *